United States Patent [19]

Rushing et al.

[11] Patent Number: 4,856,570

[45] Date of Patent: Aug. 15, 1989

[54] MULTI-USE HANDBAG

[76] Inventors: Jim Rushing; Linda Rushing, both of 577 S. Coast Hwy., Laguna Beach, Calif. 92652

[21] Appl. No.: 231,639

[22] Filed: Aug. 11, 1988

Related U.S. Application Data

[63] Continuation of Ser. No. 926,388, Nov. 3, 1986, abandoned.

[51] Int. Cl.[4] ..... A45C 3/06; A45C 13/10; A45C 13/26

[52] U.S. Cl. ..... 150/107; 150/103; 190/103; 190/116; 190/117; 383/2; 383/8; 383/13; 383/15; 224/153; 224/258

[58] Field of Search ..... 150/100, 103, 107–110, 150/104, 106; 190/103, 109, 115–117, 1; 383/2, 4, 8, 13, 15; 224/153, 258

[56] References Cited

U.S. PATENT DOCUMENTS

| | | | |
|---|---|---|---|
| 101,910 | 4/1870 | Patten | 190/103 |
| D. 235,691 | 7/1975 | Barad | 150/108 X |
| 1,104,463 | 7/1914 | Wuest | 383/2 X |
| 1,370,636 | 3/1921 | Dwyer et al. | 383/13 |
| 1,500,029 | 7/1924 | Oliver | 190/116 X |
| 1,537,956 | 5/1925 | McNally | 383/2 |
| 1,742,867 | 1/1930 | Leui | 190/116 X |
| 2,118,400 | 5/1938 | Goldberg | 150/107 X |
| 2,723,696 | 11/1955 | Kase | 150/107 X |
| 2,927,617 | 3/1960 | Kurzrock | 383/2 |
| 3,173,465 | 3/1965 | Pastini | 383/2 X |
| 3,225,805 | 12/1965 | Wise | 150/100 X |
| 3,225,806 | 12/1965 | Pollak et al. | 150/52 R |
| 3,227,338 | 1/1966 | Hall | 150/100 X |
| 3,346,155 | 10/1967 | Oechsle | 150/108 X |
| 3,443,671 | 5/1969 | Dyke | 190/103 |
| 3,746,066 | 7/1973 | McIntyre | 383/2 X |
| 4,153,092 | 5/1979 | Haslam | 150/108 |
| 4,153,146 | 5/1979 | Patton et al. | 190/903 X |
| 4,177,909 | 12/1979 | Haskell | 224/153 |
| 4,561,525 | 12/1985 | Shidner | 190/109 X |

FOREIGN PATENT DOCUMENTS

| | | | |
|---|---|---|---|
| 808759 | 8/1951 | Fed. Rep. of Germany | 383/4 |
| 878656 | 1/1943 | France | 150/107 |
| 974498 | 2/1951 | France | 190/103 |
| 1474951 | 3/1967 | France | 190/103 |
| 1557297 | 2/1969 | France | 190/103 |
| 2374866 | 8/1978 | France | 190/103 |
| 2394268 | 1/1979 | France | 150/110 |
| 2565471 | 12/1985 | France | 190/116 |
| 2579177 | 9/1986 | France | 150/107 |
| 306267 | 2/1929 | United Kingdom | 383/2 |

*Primary Examiner*—Sue A. Weaver
*Attorney, Agent, or Firm*—Stetina and Brunda

[57] ABSTRACT

A multi-use handbag is disclosed having a main storage body, at least one handle and at least one locking flap secured to one or more corners of the main storage area to an engagement member disposed along the lateral side of the handbag. Various configurations are obtainable by selective connection of the handles to the body and selective connection of the locking flaps to the engagement member.

13 Claims, 2 Drawing Sheets

MULTI-USE HANDBAG

This is a continuation of co-pending application Ser. No. 926,388, filed on Nov. 3, 1986, now abandoned.

BACKGROUND OF INVENTION

1. Field of the Invention

The present invention relates in general to article carriers and more particularly, to an improved multi-use handbag.

2. Description of Prior Art

The relvent field of the present invention is best illustrated by the following U.S. Pat. Nos.: Haskell; 4,177,909, Hall; 3,227,338, Pollak; 3,225,806,Wise; 3,225,805.

While the existing article carriers disclosed in the foregoing references may be suitable for some applications, it would be highly desirable to have an improved multi-purpose convertible handbag having an aesthetically pleasing appearance. None of the prior known article carriers combine the multi-purpose functionally with the aesthetical appearance of the handbag. The Haskell reference, for instance, teaches the use of the convertible purse by combining three components which may be separately and selectively utilized. The conversion feature of the disclosed purse basically consists of using each component separately, rather than multiplying the design of the article to correspond to the intended use of the handbag.

With the emergence of the women's liberation movement, and with the awakening of the women's active and functional role in society, the present trend is to emphasize the functionality of women's acessories such as purses. Furthermore, with the increased limitations on the availability of storage space in today's homes, it has become more important to minimize the quantity of items, especially those falling within the category of luxury or accessory items.

Therefore, there is a long felt need for article carriers that could be used for multi-purpose, while maintaining a versatile and pleasing aesthetic appearance.

Summary of the Invention

The above-stated need is provided for by the present invention whose object is to provide a single multi-purpose handbag which is convertible into a wide variety of article carriers, while still maintaining pleasing aesthetic appearance. Thus, minimizing the number of article carriers to be purchased and stored by the user.

The multi-use handbag having a main storage area or body, at least one handle and at least one locking flap secured to one or more corners of the main storage area or body, such that the locking flap is used to fasten the corner to an engaging member located along the side of the main storage area or body. The handles may be connected to the corners or sides of the handbag. The corners may be selectively folded or extended as desired to form various configurations.

BRIEF DESCRIPTION OF THE DRAWING

The above-mentioned and other drawings and features of this invention and the manner of obtaining them will become apparent, and the invention itself will be best understood by reference to the following description of an embodiment of the invention taken in conjunction with the accompanying drawings, wherein.

DETAILED DESCRIPTION OF THE PREFERRED EMBODIMENT

Figure 1:
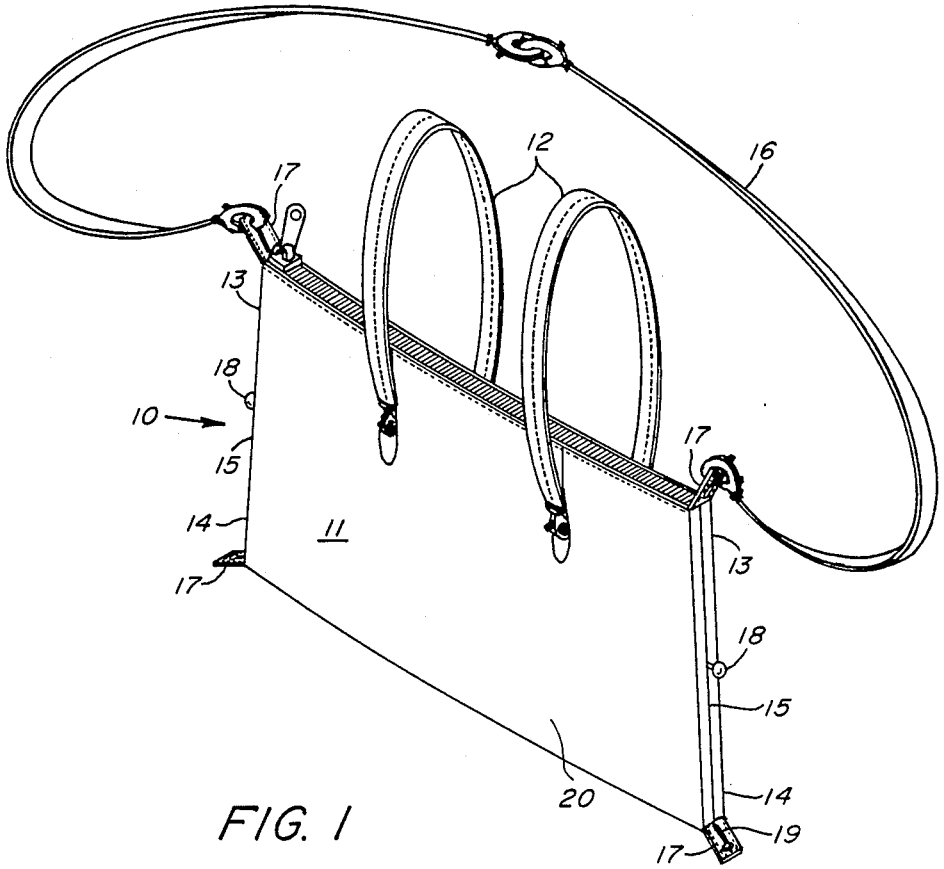
FIG. 1, is a perspective view of the multi-use handbag including a shoulder strap and a pair of handles with the corners of the handbag in an extended normal position.

Referring now to the drawings, and more particularly to FIG. 1, there is shown a multi-use handbag basically comprising a main storage area or body 11, a pair of handles 12, and means for fastening the adjacent upper and/or lower and corners 13 or 14, to the respective sides 15, of the bag 10.

The main storage area or body 11, is made of pliable, flexible or resilient material such as leather, textile or plastic to enable the folding of the lateral edges 15. While the preferred embodiment of the bag is shown in FIG. 1 as having a generally rectangular shape, other shapes and designs could be used as well.

The handbag is provided with a means for carrying the same. In the preferred embodiment, the carring means include one or more handles 12, that are removably secured to the main storage area or body 11. In another embodiment two or more handles 12, can be serially connected and attached to the upper corners 13, of the bag 10 to form a shoulder strap 16.

Figure 7:
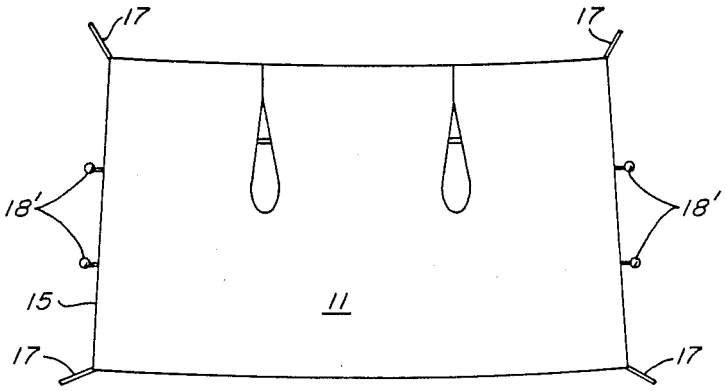
FIG. 7 is a front elevational view of an alternate embodiment of the invention.

In all the above configurations, the handbag 10, creates a versatile and pleasing aesthetic appearance. The handbag 10, and most specifically the main area or body 11, can be modified into various designs. FIGS. 1 and 7 illustrate the use of the handbag in a normal extended position. FIGS. 2, 3, 4, and 5 on the other hand, illustrate some of the alternative embodiments of the present invention. As explained more fully below such combinations of design could be simply and inexpensively achieved by folding one or more upper and/or lower corners 13 and 14 inwardly and by engaging the nipple 18 into the corresponding eye 19 of the locking flap 17.

The means for fastening adjacent upper and lower corners 13 and 14, to the respective sides may comprise connecting members such as for the four identical locking flaps 17, and a plurality of engagement members 18. The engagement members 18, may be formed as nipples, balls or any other shape member device or type of material capable of securing the flaps 17 or equivalent engageable members formed on the corners of the handbag.

In the presently preferred embodiment one locking flap 17, is secured to either an upper or lower end 13 or 14. Each flap 17, coprises a slit or eye 19, which is sized and dimensioned to the detachably engage the engagement member 18, the handle 12, or the shoulder strap 16. The engagement members 18, may be formed in the shape of a little ball or the like that engages the eye 19, of the locking flap 17. The engagement member 18 may be located along the lateral edge 15 of the handbag, and preferably at its middle, thus enabling symmetrical engagement of either or both the upper and lower ends to the respective lateral edge 15.

Figure 2:
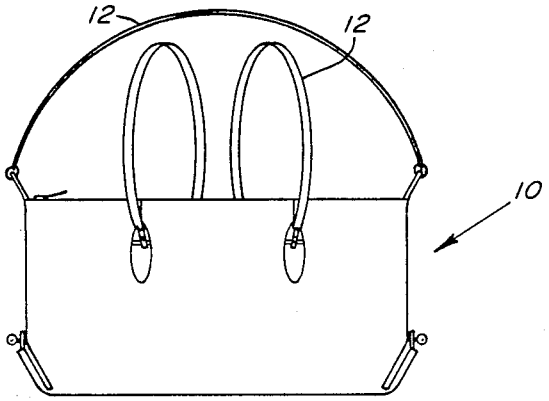
FIG. 2, is a front elevational view of the handbag with the bottom corners in a folded position.
Figure 3:
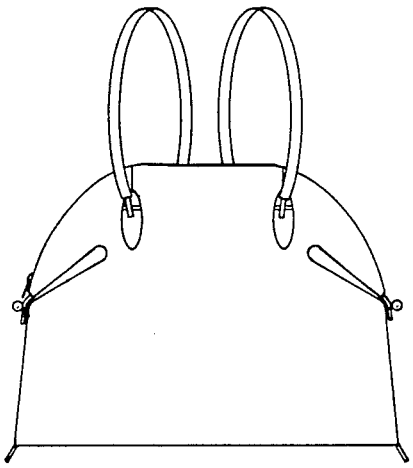
FIG. 3, is a front elevational view of the handbag showing the upper corners in a folded position.
Figure 4:
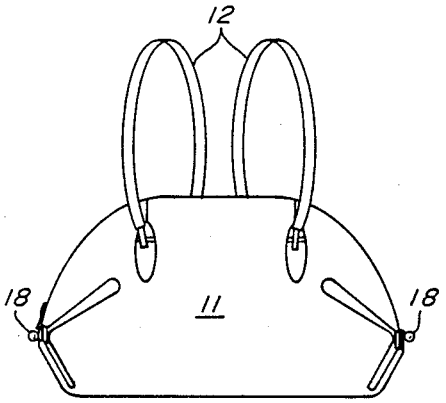
FIG. 4, is a front elevational view of the handbag showing the four corners in a folded position.
Figure 5:
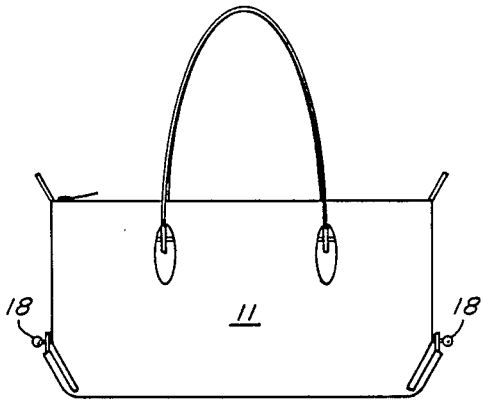
FIG. 5, is a front elevational view of the embodiment shown at FIG. 2 with the straps in a different position.

The present handbag 10, could be used in several configurations and various designs. FIGS. 1, 2, 3, 4, and 5 illustrate the various designs of the handbag 10, for use as a purse. Each handle 12, is detachably connectable to the two opposite faces or panels 20 of the handbag 10, as shown in FIGS. 1, 2, 3, and 4. In the alternative, each handle 12 could be detachably secured to a single face or side wall 20. Another configuration for the use of the handbag 10, as a purse is illustrated in FIG 2, wherein one handle 12 is connected to two opposite flaps 17.

When it is desired to carry the handbag 10, as a tote bag that it is on the shoulder of the user thereof, two or more handles could be sequentially interconnected to the desired length and simultaneously connected to either two opposite upper flaps 17. The resulting configuration is a single shoulder strap 16, as shown in FIG. 1, which enables the carrier of the handbag 10, on the user's shoulder.

Figure 6:
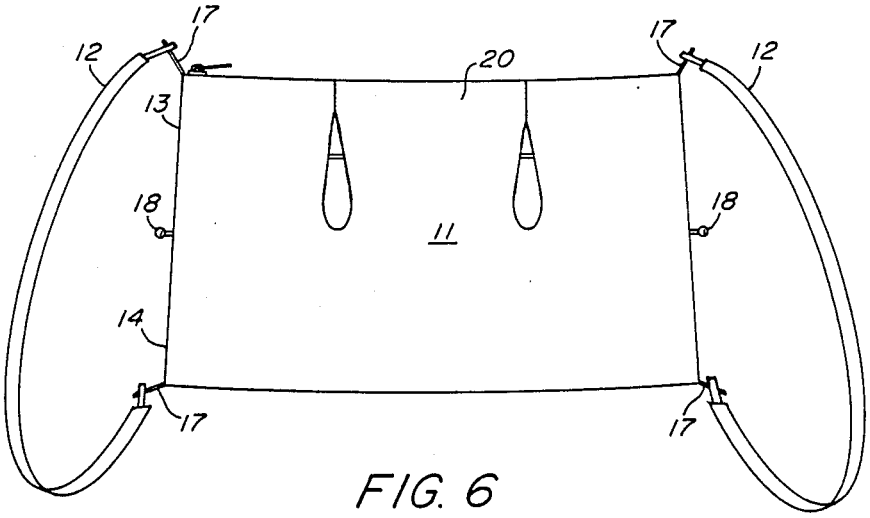
FIG. 6, is a front elevational view of the handbag with a pair of shoulder straps for carrying in a knapsack fashion.

In order to permit carrying the handbag 10, in the form of the knap-sack, FIG. 6 shows the two handles 12, each of which is connected to the adjacent upper and lower ends 13 and 14. Two or more handles can be interconnected to form a single shoulder strap of a desired length.

The handbag 10, can also be configured as a clutch purse, as illustrated in FIG. 7, in this configuration, the handbag 10, comprises a main storage area or body 11, without any handles 12 or shoulder straps 16, attached thereto.

As further illustrated in FIG. 7, a plurality of engaging members or nipples 18, could be positioned along the lateral wall 15 of the handbag 10, to permit the folding of the lateral edge 15 at different angles and to achieve additional configuration of the present invention.

While particular embodiments of the invention have been disclosed it is to be understood that various additional embodiments and modifications are possible and are contemplated within the true spirit and scope of the appended claims. Therefore, there is no intent to limit the inventor to the exact abstract or disclosure herein presented.

What is claimed is:

1. A multi-configurational handbag comprising:

a main storage area having at least one upper edge, at least one lower edge and first and second flexible lateral edges extending between said upper and lower edges and joining therewith to form at least two upper corners and at least two lower corners;

connecting tabs located on each of said corners;

at least one fastener mounted on each lateral edge at a point between one of said upper corners and one of said lower corners;

said connecting tabs being selectively connectable to said fasteners, in direct abutting relationship therewith so as to cause repositioning of said corners with resultant pliable distortions of the main storage area of the handbag thereby rendering the handbag alternately covertible between at least four configurations, said four configurations comprising:

(a) a first configuration wherein no corner connecting tabs are fastened to fasteners on said lateral edges:

(b) a second configuration wherein two upper corner connecting tabs are fastened to fasteners on said lateral edges;

(c) a third configuration wherein two lower corner connecting tabs are fastened to fasteners on said lateral edges; and (D) a fourth configuration wherein two upper corner connecting tabs and two lower corner connecting tabs are fastened to fasteners on said lateral edges.

2. The handbag as recited in claim 1 further comprising a means for carrying the main storage area of the handbag.

3. The handbag as recited in claim 2 wherein the main storage area further comprises at least two opposite side panels and wherein the carrying means comprises at least one handle and means for removably connecting said handle to at least one of said side panels.

4. The handbag as recited in claim 1 wherein said storage area has one upper edge, one lower edge, and wherein said first and second lateral edges extend between said upper and lower edges at opposite ends thereof.

5. The handbag as recited in claim 2, wherein the carrying means comprises one handle and the handbag is provided with at least one handle connector operative to removably attach said handle to at least one of said corners.

6. The handbag as recited in claim 2 wherein the carrying means comprises a plurality of handles being serially interconnected to form a shoulder strap, said shoulder strap including means for removably connecting said shoulder strap to said corners.

7. The handbag as recited in claim 2, wherein said carrying means comprises at least one handle, said at least one handle having first and second ends and wherein said handbag further comprises means for removably attaching said at least one handle to the corners of said handbag.

8. The handbag as recited in claim 1, wherein said main storage area is made of pliable material.

9. The handbag as recited in claim 1, wherein at least one of said connecting tabs comprises:

a locking flap connected to at least one of said upper and lower corners.

10. The handbag as recited in claim 9, wherein the locking flap includes an engagement eye, which is sized to receive therein one of said fasteners.

11. The handbag as recited in claim 9, wherein said at least one fastener comprises a ball-shape member secured to and extending from a lateral edge.

12. The handbag of claim 1 wherein said distortion of said flexible lateral edge is generally in the form of a U-shaped infolding of said lateral edge.

13. The handbag of claim 1 including at least one flexible side wall attached to said upper, lower and lateral edges such that engagement of said at least one connecting tab to said at least one fastener causes distortion of said flexible side wall and distortion of said flexible lateral edge.

* * * * *